United States Patent [19]

Koziol et al.

[11] Patent Number: 4,462,887

[45] Date of Patent: Jul. 31, 1984

[54] APPARATUS FOR FUSION ELECTROLYSIS AND ELECTRODE THEREFOR

[75] Inventors: Konrad Koziol, Röthenbach a.d. Pegnitz, Fed. Rep. of Germany; Malcolm F. Pilbrow, Claremorris, Ireland; Christine Zöllner, Schwaig b. Nuremberg, Fed. Rep. of Germany; Dieter H. Zöllner, Claremorris, Ireland

[73] Assignee: C. Conradty Nurnberg GmbH & Co. KG, Röthenbach a.d. Pegnitz, Fed. Rep. of Germany

[21] Appl. No.: 285,560

[22] Filed: Jul. 21, 1981

[30] Foreign Application Priority Data

Oct. 27, 1980 [EP] European Pat. Off. ..... 80106580.6

[51] Int. Cl.[3] ..... C25B 11/00

[52] U.S. Cl. ..... 204/286; 373/93; 204/294

[58] Field of Search ..... 373/91, 92, 93, 94; 204/290 R, 294, 280, 286

[56] References Cited

U.S. PATENT DOCUMENTS

| | | | |
|---|---|---|---|
| 3,385,987 | 5/1968 | Wolf et al. | 373/93 |
| 4,145,564 | 3/1979 | Andrew et al. | 373/93 |
| 4,256,918 | 3/1981 | Schwabe et al. | 373/93 |
| 4,287,381 | 9/1981 | Montgomery | 373/93 |

*Primary Examiner*—Roy N. Envall, Jr.
*Attorney, Agent, or Firm*—Lyon & Lyon

[57] ABSTRACT

Electrode for fused melt electrolysis comprising a top portion (5) of metal or metal alloy where appropriate including a cooling device (2,3) and the top portion (5) is protected at least partially by an insulating coating (4) of high-temperature resistance, and at least one bottom portion (6) of active material. The electrodes can be used more particularly for the electrolytic production of metals such as aluminium, magnesium, alkaline metals or compounds thereof and are characterized by very advantageous energy consumption combined with high operational reliability.

19 Claims, 5 Drawing Figures

APPARATUS FOR FUSION ELECTROLYSIS AND ELECTRODE THEREFOR

The invention relates to an electrode for fused melt electrolysis, more particularly for the electrolytic production of metals such as aluminium, magnesium, lithium or of compounds thereof.

Carbon electrodes, made of hard carbon or graphite are still mainly employed for the electrolytic production of aluminium, magnesium, alkaline metals or compounds thereof on a commercial scale. Although the electrodes are intended mainly to carry current, they frequently also participate in the electrode reaction themselves. The actual electrode consumption is therefore substantially higher than the theoretical rate of wear, due to the oxidation sensitivity of carbon electrodes under electrolysis conditions. The theoretical consumption rate in the fused melt electrolysis of aluminium is 334 kg carbon/ton of aluminium, but the actual carbon consumption amounts to approximately 450 kg of carbob/ton of aluminium.

Similar problems arise for the electrodes used in the production of magnesium, sodium, lithium and cerium metal mixes. Side reactions of an oxidizing kind on the electrode part which is immersed in the molten salt as well as losses due to atmospheric oxygen on the part which projects from the melt result in irregular and premature wear of the electrodes. To this must be added the destructive action of the graphite deposits formed from electrode constituents or their products. Tests have already been undertaken, in which carbon electrodes are converted into a suitable electrode material by impregnation, followed by thermochemical treatment and conversion into composite carbon-silicon carbide materials. However, in practice these tests have not led to any substantial improvement of fused melt electrolysis.

The above-described disadvantages of carbon electrodes as well as rising costs of graphite and hard carbon have given rise to the development of form-stable electrodes. It is hoped thereby not only to replace petro-carbon, a petrochemical raw material, the consumption of which in the Federal German Republic for fused melt electrolysis alone amounts to approximately 500,000 tons per annum, but also to achieve savings in energy consumption.

To this end, a number of ceramic materials for example in accordance with the British Patent Specification No. 1,152,124 (stabalized zirconium oxide), the U.S. Pat. No. 4,057,480 (substantially stannic oxide), the German Offenlegungsschrift No. 27 57 898 (substantially silicon carbide valve metal boride carbon), or according to the German Offenlegungsschrift No. 24 46 314 (ceramic parent material with a coating of spinel compounds) have all been described. Reference will also be made to a proposal for the use of non-oxidizable compound substances with a high degree of chemical purity in accordance with the European Patent application No. 80103126.1, filed by the applicant on the 4th June 1980.

The disadvantage in the use of electrodes of ceramic materials is their electrical conductivity which is frequently only moderate to medium, even after the addition of conductivity-increasing components. This is acceptable only for processes in which the electrode dimensions are small and the current path is therefore short. However, this applies primarily only to electrolysis in aqueous media while electrodes for fused melt electrolysis, for example of aluminium, have substantial dimensions. For example, electrodes for the production of aluminium can have dimensions of up to 2250×950×750 mm while typical graphite electrodes for the production of aluminium can have a size of 1700×200×100 mm or diameter of 400×2200 mm, depending on the type of process. The production of such solid blocks of the above-mentioned ceramic materials is expensive and encounters substantial difficulties with respect to stability to alternating temperatures and electrical internal resistance. Recently, the efforts of current consuming industries have been directed especially to a reduction of specific energy consumption and for this reason solid ceramic electrodes have not so far been accepted in practice.

It is the object of the invention to provide a novel kind of electrode for fused melt electrolysis, in which the above described disadvantages of the prior art are ameliorated. In particular, it is intended to provide an electrode capable of operating reliably with an exceptionally low current/voltage loss and for which the spectrum of known and future active materials can be used in the same manner. The electrode should also be particularly easy to maintain and to repair. This kind of electrode is to be used preferably as anode.

The problem is solved by providing an electrode for fused melt electrolysis comprising a top portion of metal or metal alloy at least partially protected by an insulating coating of high temperature resistivity, and at least one bottom portion of active material.

Liquids, such as water or gas, for example air, can be used as coolants. Such electrodes have already been proposed for use in the production of electric steel in electric furnaces in which an arc extends from the electrode tip. The existence of the arc and its possibility of traveling, the resultant extreme temperatures near to the arc as well as the atmosphere in the electric steel furnace and the kind of electrode process is so substantially different from fused melt electrolysis that the possibility of using such electrodes for performing fused melt electrolysis has not been considered. As regards the relevant prior art, reference should be made, for example, to the British Patent Specification No. 1,223,162, the German Auslegesschrift No. 24 30 817 or the European Offenlegungsschrift No. 79302809.3. The electrodes mentioned in these documents are described by reference to the special requirements of the arc electrode and in terms of the efforts made to meet the specific requirements of electro-steel production.

In the electrode according to the invention, a moulding, which can be detachably surmounted, is used as insulating coating. The term "insulating" within the scope of the invention is to refer to a material which is inert and shielding with respect to the electrolysis medium and where approproate can also be electrically insulating. For most purposes of the electrode or anode according to the invention it is particularly advantageous if at least the region of the moulding in contact with the electrolyte and the resultant products shields the metal shank and, where appropriate other metallic parts, more particularly the nipple, in gas-tight and liquid-tight manner.

The high temperature resistant, insulating moulding can be an individual tube. Advantageously, it can however also be a series of tubular sections, segments, half shells or the like which surround the bottom region of the top portion of the electrodes as far as the region of the screw nipple, and where appropriate beyond the latter.

The material of the insulating moulding can be high temperature resistant ceramics but also, for example, graphite, which is provided with an insulating coating. Such insulating, high temperature resistant ceramic or other materials are known.

A series of advantages, which will be described subsequently, can be achieved by the use of a detachably surmounted moulding, more particularly in the form of a series of tubular sections.

According to one preferred embodiment of he electrode according to the invention, the insulating moulding is disposed between a bottom part region of the top portion of the metal and the bottom consumable region so that the external edges of the moulding extending in the direction of the electrode axis and the external edges of the outer region associated with the top portion of metal are substantially in flush alignment with each other.

The electrode according to the invention is not subject to any restrictions regarding the abutment which supports the moulding. It can also be a mating member consisting of high temperature stressable, insulating material, it can be part of the active member itself or a combination thereof. Generally however the insulating moulding will not be mounted solely on the active part, if this consists of consumable material, but will be supported at least partially by a non-consumable, heat resistant material.

The position of the moulding can of course be controlled in suitable manner when the electrode is produced. In one preferred embodiment of the electrode according to the invention the insulating moulding can also be thrust onto the abutment by pins, screw fasteners etc. provided in bores in the top portion, for example by the additional provision of springs, even during operation of the electrode without the need for removing the electrode from the electrolysis furnace. Irrespective of the provision of bores and screw fasteners or the like it can also be advantageous to mount the insulating moulding slidingly or loosely with respect to the metal shank so that in the event of failure of a part segment or breakage of an individual tube, for example due to mechanical damage, the remaining part segments which are intact or the individual tube itself are able to slip forward, i.e. they are able to move in the direction of logitudinal axis of the electrode.

Depending on the use of the electrode it is possible to mount the insulating moulding on retainers which are advantageously attached to the metal of the inner cooling unit. This will be considered primarily for uses of the electrode where free movability or advancing of intact (insulating or electrically conductive) individual segments is not essential in the event of damage of one of the segments situated below.

Within the scope of the invention it is also possible for the insulating moulding to surround not the entire region of the metal shank but an insulating, highly refractory injection compound, anchored to retaining members, is used in place of extending moulding in a zone where lower stresses can be expected. Such insulating injection compounds are known and can be attached by means of retaining members for example by means of soldering.

Amorphous carbon, graphite, ceramic conductors for example those mentioned initially, or a compound of inorganic fibres with an electrochemically active metal can be used as active materials which are connected to the upper portion by means of one or more screw nipples, or where appropriate by means of screwthreading. In this context, special reference should be made to the European Patent application No. 80103126.1 by the applicant, where particularly, preferred compound materials of inorganic fibres with an electrochemically active material are mentioned. By the specific reference to the said European Patent application it is then intended that the relevant description of the active material and their arrangement are to be regarded as being completely part of the present application. The European Patent application mentions in detail that the active material can be formed from a plurality of rods, plates, tubes or the like which are interconnected or separate. However, the arrangements of rods, plates or tubes mentioned in that specification are not to be subject to any restrictions in respect of the ceramic or other active materials which can be used in the present invention. In other words, the active materials or composites described in the cited European application are to be taken into account within the scope of the present invention. The constructive arrangements of the active parts described elsewhere can be connected in the electrode according to the present invention to the upper metalic portion, either by means of nipples, screwthreading or the like.

It is also possible for the bottom portion to comprise active material in several units which are retained by one or more nipple connections and for the units to be arranged adjacently and/or one beneath the other. More particularly, with respect to consumable active substances such as graphite, it is possible to take into consideration intermediate members of materials to which a completely consumable unit can then again be screwmounted. This enables the last active unit to be completely consumed without endangering the nipple connection by means of which the metalic top portion is connected.

It is possible to dispense with the provision of a cooling device in cases in which the top portion with the nipple is not exposed to excessivley high temperatures.

The electrode according to the invention offers a number of advantages: Special mention among these should be made of the extremely low current or voltage losses on the path extending to the active part of the electrode. This allows for substantial energy savings compared with conventional solid blocks, either those of carbon, graphite or ceramic material. Furthermore, side wear is minimized since only the "active" part of the electrode and not the entire electrode is exposed to the corrosive electrolysis medium and the reaction gases and vapours developed thereby. Finally, the electrode is versatile, because its construction permits the use of the spectrum of active materials fundamentally suitable for the field of fused melt electrolysis.

During manufacture the insulating moulding can also be introduced in a purpose-adapted position. The mechanical stressability can be improved by the use of an insulating, externally disposed solid part. By dividing the insulating external zone into segments it will not be necessary to exchange the entire electrode in the event of breakdown or damage, since the damage can be economically and rapidly remedied by the introduction of the appropriate part member. Such loose mounting of the insulating moulding, to the extent to which this is formed from a plurality of part members, leads to an "automatic" follow-up movement of the above disposed segments in the event of mechanical or other destruction of defective segments situated below, and this can be additionally ensured, where appropriate, by attached springs. The electrode therefore continues to be operational, even when the damage has already taken place since the most endangered electrode region at the bottom, nearest to the working zone of the electrode, is protected by the "automatic" downwards sliding of elements which are intact.

Although the insulating moulding or the insulting coating, if this comprises a series of individual segments or half shells, can have some clearance obtained by the kind of axial and internal support, the tongue and groove system will provide complete and comprehensive protection for the sensitive metal region of the electrode. If the bottom region of the "protective shield" of the electrode is nevertheless damaged, the electrode can usually continue to operate, for as long as is necessary to replace the consumable part, for example of graphite. When the electrode is removed, the damaged of graphite. When the electrode is removed, the damaged individual segment etc. can readily be replaced.

Some particularly preferred electrode constructions in accordance with the invention, intended especially for use as anodes, are shown in FIGS. 1 to 5. Particularly those electrodes and anodes are shown in which the top portion of conductive metal has an upper part of larger diameter and a lower part of smaller diameter. The part of smaller diameter is then at least partially covered by the insulating moulding. This arrangement is especially preferred within the scope of the invention although the invention is neither confined thereto nor is it restricted to the particularly advantageous embodiments in accordance with the illustrations below. Identical components have the same reference numerals in the illustrations in which:

Figure 1:
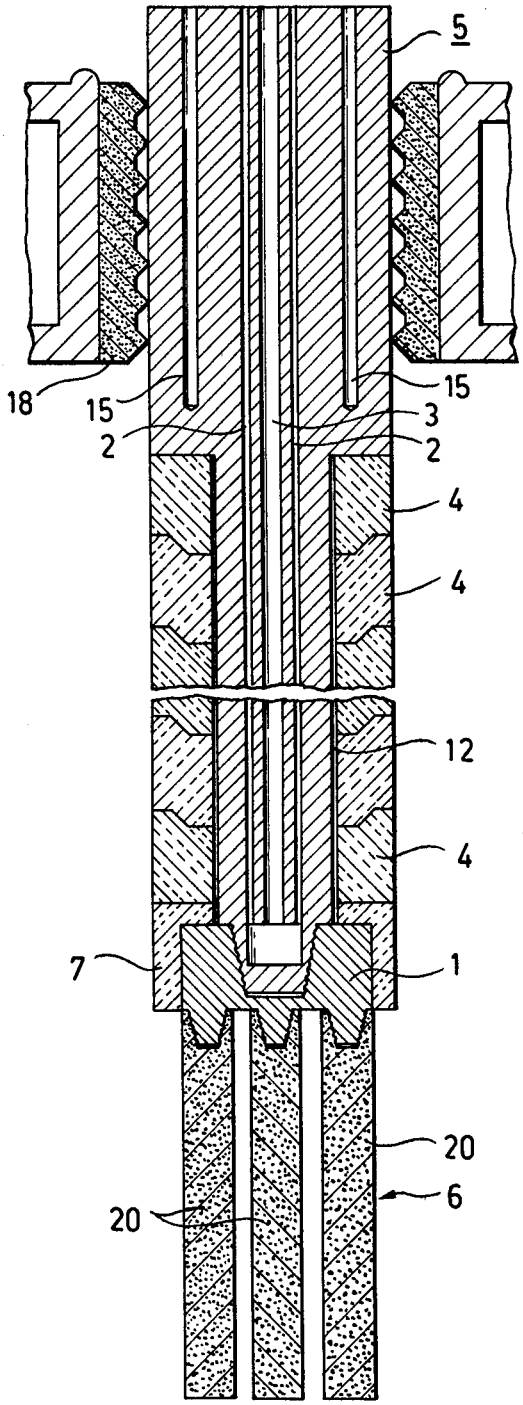
FIG. 1 is a longitudinal section through an electrode according to the invention.

In the electrode according to FIG. 1, the cooling medium, for example water, air or inert gas, is introduced through the header duct 2 and returned through the return duct 3. The cooling medium also enters into a chamber within the screw nipple 1, which can be constructed of cast iron, nickel or a temperature-stable, corrosion-resistant metal alloy. The top portion 5 of metal consists of a top region of larger diameter and a lower region of lower diameter which is incorporated into the screw nipple 1 and forms the connection to the bottom portion of consumable material, for example graphite or ceramic active material. The insulating moulding 4 is supported by an abutment 7, for example of high temperature resistant, insulating ceramics. The top region of the insulating moulding 4 is defined by the top edge of the region of larger diameter of the metal shank.

In the electrode illustrated in FIG. 1, the insulating moulding 4 is subdivided into segments which are able to slide in the direction of the electrode axis if a lower segment should break. Alternatively however these segments can also be retained by hook elements 14.

In addition to the cooling parts 15 it is possible for additional bores 8 to be provided and pins 9 inserted therein provide a firm seat for the insulating moulding 4 via the spring 10.

Figure 2:
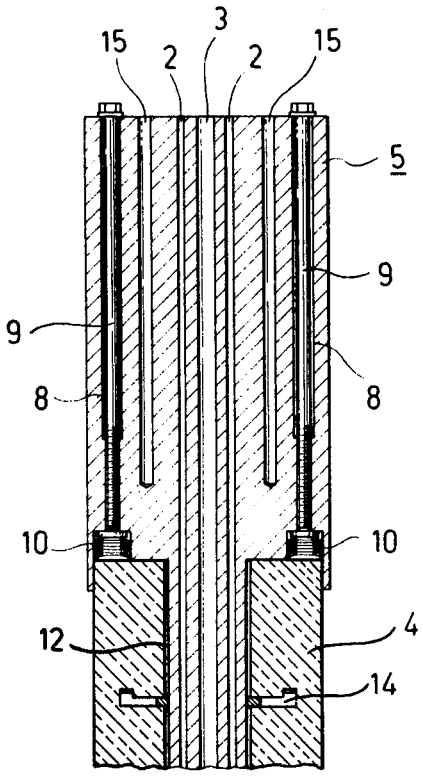
FIG. 2 is a longitudinal section through an electrode according to the invention in which the region protected by insulation is not shown completely and the adjoining consumable part is not shown.
Figure 3:
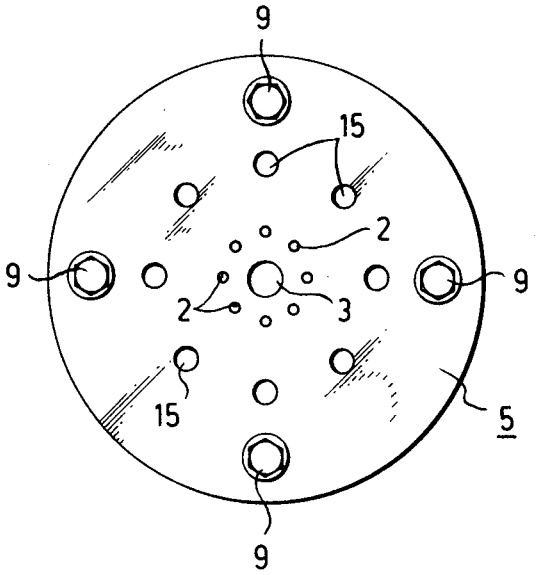
FIGS. 3 and 4 are cross-sections through the top portion of the metal or the part region thereof of smaller diameter.
Figure 4:
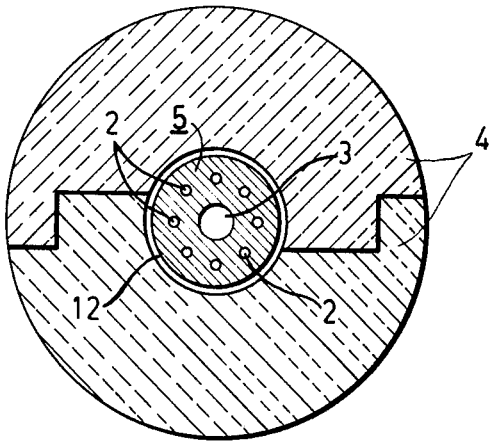
Figure 5:
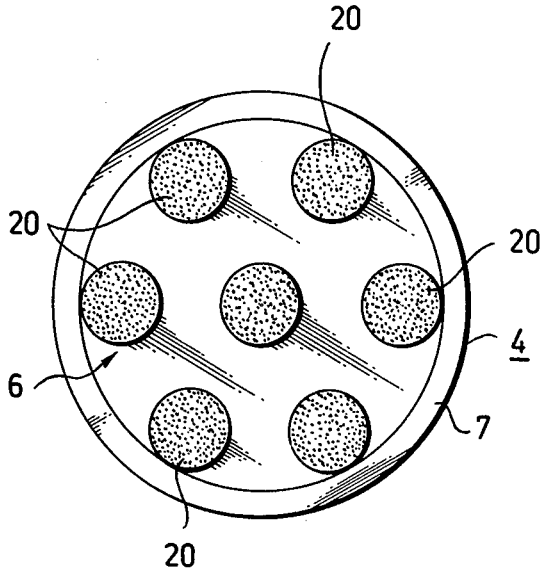
FIG. 5 is a bottom view of the active part of the electrode.

FIG. 2 as well as FIG. 4 discloses the use of half shells joined together or rings, for example of graphite, which is covered with an insulating coating.

The bottom portion 6 of consumable or resistant material is divided into a series of individual rods 20 which are joined by means of the nipple 1.

The preferred lateral supply of current is obtained by means of jaws 18, more particularly of graphite, which are mounted by means of retainers, not shown, more particularly on the metal shank. FIG. 1 shows the alternative possibility of mounting the jaws 18 on the current supply busbar itself.

Gas flushing ducts can be provided between the insulating stratum 4 and the top portion 5 but are not shown in detail in the illustrations. Any damage to the insulating ceramic can readily be detected by gas flushing, for example by reference to the corresponding pressure drop. Furthermore, a certain cooling action can also be achieved thereby. It is also within the scope of the invention, and this is also not shown in the illustrations, that the top portion 5 and/or the middle connection 1 or the external surfaces thereof can be covered with a high temperature resistant coating. Depending on the dimensions of the high temperature resistant insulating coating 4, the first mentioned high temperature resistant coating can be electrically conductive or electrically insulating. In an insulating embodiment this results in a second line of protection which can come into action when the externally disposed insulating coating 4 breaks. If such an event is not expected, depending on operating conditions, it is also possible for the coating to consist of conductive material which is resistant to high temperature and which will then perform the action of a "heat shield" or "inert shield" to protect the metal disposed therebelow.

What we claim is:

1. Apparatus for fusion electrolysis, particularly for the elctrolytic production of aluminum, magnesium, alkaline metals and of compounds thereof, having an electrode said electrode comprising: an electrical current conducting metallic top portion and at least one replaceable bottom portion of active material, a threadable interconnection means between said portions; the top portion including a cooling means having a header and return duct; said top portion further including at least one insulating support; and a plurality of ring-like insulative moulding sections slideably and detachably surrounding at least a portion of the top portion and supported by the insulating support.

2. An apparatus as claimed in claim 1, wherein said moulding and the external edging of said top portion are substantially flush with one another.

3. An apparatus as claimed in claim 1, wherein said moulding is at least partly supported by said screw means.

4. An apparatus as claimed in claim 1, wherein a cut is provided in the metal of said top portion and an abutment is disposed approximately in the region of said screw means, and wherein said moulding is supported between said cut and said abutment.

5. An apparatus as claimed in claim 1, wherein said moulding is at least partly supported by said bottom portion of active material.

6. An apparatus as claimed in claim 4, wherein said moulding is retained on said abutment by fastening means guided in bores of said metal top portion.

7. An apparatus as claimed in claim 1, wherein said bottom region of the top portion is provided with a dense highly stressable, conductive coating of ceramic.

8. An apparatus as claimed in claim 1, wherein said insulative moulding consists of high temperature resistant ceramic provided with an insulating coating.

9. An apparatus as claimed in claim 1, wherein said insulating moulding consists of a graphite tubing provided with an insulating coating.

10. An apparatus as claimed in claim 8 or claim 9, in which said insulating moulding is mounted on retainers attached to said metal top portion.

11. An apparatus as claimed in claim 10, wherein said moulding is partially replaced in the top region of said metal portion by an insulating, refractory injection compound which is anchored to retaining members.

12. An apparatus as claimed in claim 1, in which said bottom portion is formed from a plurality of separable parts.

13. An apparatus as claimed in claim 12, wherein said separable parts are arranged adjacently and retained by one nipple connection means.

14. An apparatus as claimed in claim 12, wherein said separable parts are arranged one below the other and are retained by nipple connection means.

15. An apparatus as claimed in claim 1, wherein said moulding is mounted in fluid tight manner, at least in the region which can come into contact with the elctrolyte and resultant products.

16. An apparatus as claimed in claim 1, in which the active material comprises amorphous carbon.

17. An apparatus as claimed in claim 1, wherein said active material comprises graphite.

18. An apparatus as claimed in claim 1, wherein said active material comprises a ceramic conductor.

19. An apparatus as claimed in claim 1, wherein said active material comprises a compound of inorganic fibres with an electrochemically active material.

* * * * *